United States Patent [19]

Stenlund

[11] Patent Number: 4,960,167

[45] Date of Patent: Oct. 2, 1990

[54] HEAT EXCHANGER

[75] Inventor: Stig Stenlund, Saltsjöbaden, Sweden

[73] Assignee: Hypeco AB, Malmo, Sweden

[21] Appl. No.: 224,947

[22] PCT Filed: Feb. 18, 1988

[86] PCT No.: PCT/SE88/00069

§ 371 Date: Jul. 28, 1988

§ 102(e) Date: Jul. 28, 1988

[87] PCT Pub. No.: WO88/06706

PCT Pub. Date: Sep. 7, 1988

[30] Foreign Application Priority Data

Feb. 24, 1987 [SE] Sweden ..... 8700772

[51] Int. Cl.[5] ..... F28D 7/10; F28F 1/42; F28F 21/06

[52] U.S. Cl. ..... 165/40; 165/46; 165/51; 165/95; 165/154; 165/905; 165/916; 165/41; 123/41.33; 184/104.3

[58] Field of Search ....., 165/46, 51, 95, 154, 165/905, 916; 123/41.33, 196 AB; 184/6.22, 104.3, 104.1

[56] References Cited

U.S. PATENT DOCUMENTS

| | | | |
|---|---|---|---|
| 2,943,845 | 7/1960 | Jaklitsch | 165/154 |
| 3,105,708 | 10/1963 | Esty | 165/46 |
| 3,374,066 | 3/1968 | Farrant | 165/154 |
| 3,731,731 | 5/1973 | Kyvsgaard et al. | 165/46 |
| 3,802,491 | 4/1974 | Plank, Jr. et al. | 165/154 |
| 3,934,618 | 1/1976 | Henderson | 165/154 |
| 4,345,644 | 8/1982 | Dankowski | 165/154 |
| 4,461,347 | 7/1984 | Layton et al. | 165/154 |
| 4,502,533 | 3/1985 | Nielson | 165/154 |
| 4,778,002 | 10/1988 | Allgäuer et al. | 165/154 |

FOREIGN PATENT DOCUMENTS

| | | |
|---|---|---|
| 0042613 | 12/1981 | European Pat. Off. . |
| 2747846 | 5/1978 | Fed. Rep. of Germany . |
| 3242531 | 5/1984 | Fed. Rep. of Germany . |
| 58-80493A | 6/1981 | Japan . |
| 76027028 | 2/1976 | Sweden . |
| 73071656 | 5/1981 | Sweden . |
| 80044704 | 2/1983 | Sweden . |
| 82074634 | 8/1988 | Sweden . |
| 209081 | 8/1924 | United Kingdom . |

*Primary Examiner*—John Ford

*Attorney, Agent, or Firm*—Browdy and Neimark

[57] ABSTRACT

A heat exchanger for exchange of heat between two liquid media, of which at least one medium is contaminated and/or readily gives rise to deposits or coatings, such as e.g. contaminated water, includes two flow chambers mutually separated by a common liquid-impervious partition wall (1). The partition wall is tubular with a substantially circular cross-sectional and open ends forming respectively an inlet (2) and an outlet (3) for a first media. The partition wall is surrounded by a cylindrical sleeve-like outer wall (4) extending coaxially with the partition wall in spaced relationship therewith, and having its axial ends sealingly connected to the partition wall (1), and provided with an inlet (5) and an outlet (6) for the second medium so as to define a flow chamber for the second medium. At least the major part of the sleeve-like outer wall (4) is elastically flexible. This flexibility allows the dimension of the flow chamber to vary with changes in volumetric flow, thereby counter-acting blocking tendencies. The outer wall (4) can also be manipulated manually to loosen blockages. It also gives freeze protection.

7 Claims, 1 Drawing Sheet

HEAT EXCHANGER

Figure 1:
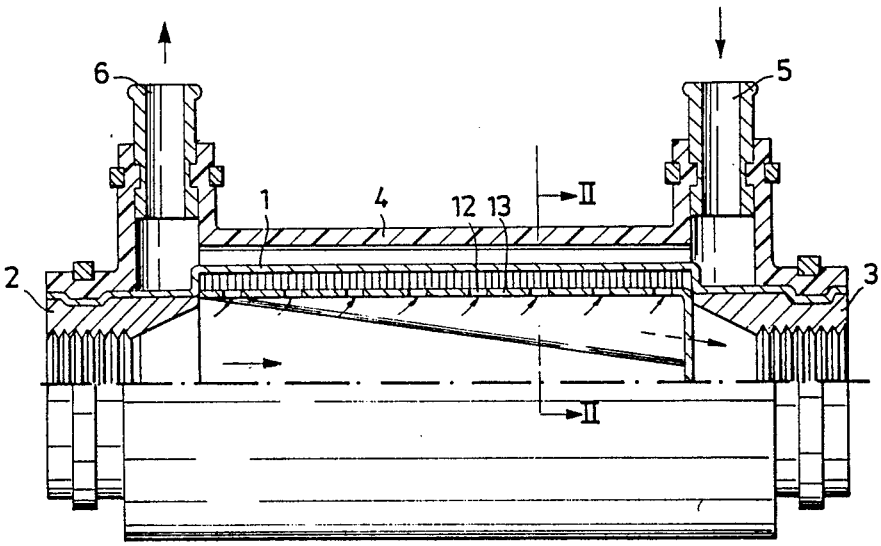

The present invention relates to a heat exchanger for effecting an exchange of heat between two liquid media and being of the kind set forth in the preamble of the following claim 1.

The inventive heat exchanger has been developed primarily for heat-exchange between two media in those cases where at least one of the media involved is contaminated and/or is liable to cause deposits or coatings to form on the wall surfaces of the medium-flow channels.

When contaminated, or impure, liquid media, such as sea water for example, are used for cooling purposes, for instance to cool the engines of watercraft, there is a serious risk that the heat exchanger channels through which the water flows will become blocked and that coatings or deposits may form on the wall surfaces of the channels and therewith on the heat-transfer contact surfaces of the heat exchanger. Both of these phenomenon impair the heat-exchange function of the heat exchanger. In order to reduce the risk of blockaging, the heat-exchange flow channels for the medium in question must be given large flow areas, which increases the volume of the heat exchanger and lowers its effectiveness. There is at present no satisfactory method of preventing coatings or deposits from forming on the walls of the flow channels, and consequently it is necessary, at regular intervals, either to clean the heat-transfer surfaces or to replace the entire heat exchanger. The only alternative in this regard is to so over-dimension the heat exchanger that it will provide an acceptable heat-exchange effect even when the heat-transfer surfaces are thickly coated. The degree of contamination of impure media, such as sea water for example, will often vary widely and rapidly, and hence when such media is used for heat exchanging purposes, there is a significant risk that the heat exchanger will become blocked and lose its effectiveness. One example in this context are heat exchangers intended for the engines of powered watercraft, which in unfavourable circumstances may be supplied with cooling water which is so highly contaminated as to block or clog the heat exchanger.

The object of the present invention is to provide a heat exchanger of the kind disclosed in the introduction which has, from the aspect of heat transfer, relatively effective flow channels which present comparably small flow areas, but which nevertheless have only a slight tendency to become blocked or coated on the contact surfaces and with which the blockages and coatings can be cleared by external manipulation without needing to dismantle the heat exchanger, therewith enabling at least one of the media used in the heat exchanger to be contaminated and/or of a kind which will give rise to coatings or deposits. Another object of the invention is to render such a heat exchanger proof against freezing when the comtaminated and/or coating-engendering medium used is water, without addition of anti-freeze substances, which is the normal practice, for instance in the case of heat exchangers which are used to cool watercraft engines with the aid of sea water.

These objects are achieved by means of a heat exchanger which is constructed in accordance with the following claims.

Figure 2:
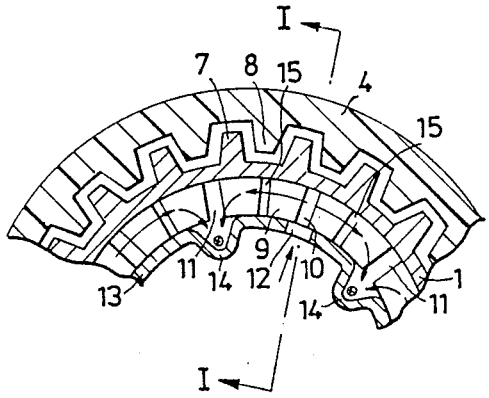

The invention will now be described in more detail with reference to the accompanying drawing which illustrates schematically and by way of example a conceivable and advantageous embodiment of the inventive heat exchanger, and in which FIG. 1 is a side view, partly in axial section, of the inventive heat exchanger, and FIG. 2 is a partial, radially sectioned view of the heat exchanger in larger scale.

The illustrated exemplifying embodiment of the inventive heat exchanger is intended, for instance, for cooling the cooling water or oil circulating in the engines of powered watercraft, with the aid of sea water as a coolant.

The heat exchanger includes a tube 1 which is substantially of circular cross-section and the axial ends of which are open. Tho tube forms a liquid-impervious partition wall which separates the two media, of which one medium flows in the tube 1 and in heat exchange contact with the inner surfaces thereof, whereas the other medium flows around the outside of the tube, in heat exchange contact with the outer surfaces thereof. The ends of the tube 1 have fitted therein respective internally screw-threaded bushes 2 and 3, by means of which the heat exchanger can be connected to the circuit which carries the medium to be cooled, for instance the cooling water or oil of a watercraft engine, which medium is assumed to be essentially clean within acceptable limits. The tube or partition wall 1 thus encloses the flow chamber intended for a first of said media. The other flow chamber of the heat exchanger intended for the second of said media, which may be contaminated and/or of a kind which is liable to give rise to deposits or coating formulations, is formed by a space located between the outer surface of the partition wall 1 and a sleeve-like outer wall 4 which extends coaxially with and around the partition wall 1 at a radial distance therefrom. The axial ends of the tubular outer wall 4 are connected in a liquid-tight manner to the outer surface of the parition wall 1, and the outer wall 4 is provided in the vicinity of its ends with an inlet 5 and an outlet 6 for the second cooling medium.

In accordance with the present invention the sleeve-like outer wall 4 is made of an elastic, flexible material, such as rubber or an elastomer. As a result of the elastic flexibility of the outer wall 4, the wall is able to move relative to the rigid partition wall 1, thereby enabling particles and other contaminants in the flowing medium to pass inside the outer tubular wall more easily, and to avoid blockaging to a significant extent. This flexibility of the outer wall 4 also enables the radial dimension of the flow chamber located between the partition wall 1 and said elastically flexible outer wall 4 to vary, such as to be smaller when the volumetric flow is small and larger when the volumetric flow is large. In the event of blockaging occurring in said flow chamber, the pressure therein will increase and therewith cause the radial dimension of the flow chamber also to increase, thereby facilitating passage of the contaminants causing the blockage. The elastically flexible outer wall 4 is also able to move forwards and backwards in an axial direction along the outer surface of the partition wall 1, in response to variations in pressure drop, which counteracts blockaging tendencies and, to a certain extent, also fouling of the outer surface of the partition wall 1. If it is desired to remove the blockages and coatings of the aforesaid kind, it is possible to press-in or draw-out the elastically flexible outer wall 4 manually, and/or loosen the blockages and coatings by rotating the outer wall 4 about its longitudinal axis and moving the wall longitudinally.

When the contaminated medium is in ample supply, as in the illustrated case, the inner surface of the elastically flexible outer wall 4 may be smooth, so that a relatively large volumetric flow of the contaminated medium can be used to achieve the desired heat exchange effect. The contaminated medium used is normally water, which has very favourable properties from the aspect of heat transfer. It is also advantageous, however, to increase the effective area of the heat transfer surfaces, and this can be achieved advantageously by providing the outer surface of the partition wall 1 and the inner surface of the elastically flexible outer wall 4 with axially extending fins 7 and 8 respectively, as shown in the illustrated embodiment. In this case the fins 8 on the elastic outer wall 4 are, advantageously, somewhat lower than the fins 7 on the outer surface of the partition wall 1, so that the whole of the outer surface of the partition wall 1 is available for heat-exchange contact with the flowing medium.

When the medium flowing between the partition wall 1 and the elastic outer wall 4 is water, the illustrated inventive heat exchanger is proof against freezing, without requiring the addition of anti-freeze substances, partly because the flow chamber located between the partition wall 1 and the outer wall 4 has only a small radial dimension and partly because the outer wall 4 is elastically flexible. A further contributary feature in this regard is that the spaces between the flanges 7 on the partition wall 1 are conical and partially filled by the elastic fins 8 on the elastic outer wall 4. Consequently, the thin ice layer which forms when the water freezes, and therewith the subsequent increase in volume, will not press on the partition wall 1, but is more likely to loosen from the partition wall or to fracture as a result of its inability to absorb tension and bending stresses.

The flow chamber located inwardly of the partition wall 1 and intended for accommodating the cooled medium, which is normally relatively clean, can be configured in many different ways. Even though this medium may have unfavourable heat-exchange properties, for example consists of oil, a very good total heat-exchange effect can be achieved with the inventive heat exchanger, when the flow chamber which is located radially inwards of the partition wall 1 and which is intended for said medium is constructed in a manner to produce laminar flow of said medium in accordance with the heat-exchange principle described in the International patent application PCT/SE No. 84/00245 corresponding to U.S. Ser. No. 847,659. The illustrated, exemplifying heat exchanger is constructed in this way, by providing the inner surface of the partition wall 1 with a large number of radially and inwardly directed, peripherally extending fins 9 which are integral with the partition wall 1 and which define therebetween peripherally extending, slot-like flow channels in which the cooled medium flows peripherally in lamina flow. The fins 9 are broken by axially extending, circumferentially dispersed distributing channels 10 and collecting channels 11. The medium flows into the distribution channels 10 through apertures 12 provided in a cylindrical plate 13 located inwardly of the radially inwardly facing edges of the fins 9. The medium flows from the distribution channels 10 peripherally into the slot-like flow channels located between the fins 9, and into the axially extending collecting channels 11 and the axially extending troughs 14 in the cylindrical plate 13, said troughs being located inwardly of the collecting channels 11 and widening in the flow direction. The medium flows from these channel-forming troughs 14 out through the outlet bush 3.

The flow path of the medium from the inlet 2 to the outlet 3 is marked with arrows in FIGS. 1 and 2. The peripherally extending fins 9 located between the distribution channels 10 and the collecting channels 11 are also broken by means of narrow slots 15, the purpose of which is explained in detail in the aforementioned International patent application, to which reference is made here for a more detailed description of this heat exchange principle. If the heat exchange medium flowing radially inwards of the tubular partition wall 1 also needs to be cleansed, in order to prevent blockaging of the narrow peripheral flow channels between the fins 9, a conical net-structure may be placed inwardly of the inwardly facing bottom surfaces of the troughs 14 on the cylindrical plate 13, therewith effectively filtering said medium.

I claim:

1. A heat exchanger for effecting an exchange of heat between two liquid media, comprising means for forming two flow chambers which are mutually separated in a liquid-tight manner by means of a common liquid-impervious partition wall and each of which is intended to conduct one of said media therethrough, characterized in that the partition wall is substantially tubular with a generally circular cross-section having on its inner surface a plurality of peripherally inwardly extending fins which define therebetween peripherally extending slot-like flow channels for said one medium said partition wall having open axial ends which form an inlet and an outlet respectively for said one medium; in that the partition wall is encircled by a substantially cylindrical sleeve-like outer wall which extends coaxially with the partition wall in spaced relationship therewith, the axial ends of said cylindrical outer wall being sealingly connected to the outer surface of the partition wall; in that said outer wall is provided with an inlet and an outlet for the other of said media; in that the cylindrical outer wall defines with the partition wall a flow chamber for said other medium; in that at least the major part of the cylindrical outer wall is formed of an elastically flexible polymeric material, such as to enable said outer wall to move relative to the partition wall and such that the radial distance between the outer wall and the partition wall can vary locally; and in that the outer surface of the partition wall has provided thereon axially extending, radially projecting fins and the elastically flexible outer wall is provided with axially extending, radially inwardly directed fins located between said fins on the outer surface of the partition wall; said inlet and said outlet for said other medium being located in the vicinity of a respective axial end of the flexible outer wall.

2. A heat exchanger according to claim 1, characterized in that the fins (8) on the elastically flexible outer wall (4) have a smaller radial dimension than the fins (7) on the outer surface of the partition wall (1).

3. A heat exchanger according to claim 1, characterized in that the fins (7) on the outer surface of the partition wall (1) and also the fins (8) on the elastically flexible outer wall (4) have a trapezoidal cross-sectional shape.

4. A heat exchanger according to claim 1, wherein said peripherally inwardly extending fins on the inner surface of the partition wall are broken by a plurality of axially extending slots which are spaced uniformly around the periphery of said partition wall and which serve alternatively as distribution channels and collecting channels for conducting said first medium to and from said peripherally extending flow channels; and in that the distribution channels communicate with said inlet for said one medium through apertures provided in a cylindrical sleeve arranged radially inwards of said fins and abutting the radially inner edges of said fins, and in that the collecting channels communicate with the outlet for said one medium through axially extending troughs formed in said cylindrical sleeve.

5. A heat exchanger for effecting an exchange of heat between a first liquid medium and a second liquid medium, comprising a first liquid medium receiving means comprising a first heat-exchange changer and a second liquid medium receiving means comprising a second heat-exchange chamber, said first and second chambers being mutually separated in a liquid-tight manner by a common liquid-impervious substantially tubular partition wall having a generally circular cross-section, said first heat-exchange chamber being located inside and said second heat-exchange chamber being located outside said partition wall, said tubular partition wall having open axial ends forming an inlet and an outlet respectively for a flow of said first medium intended to pass through said first heat-exchange chamber, and a substantially cylindrical sleeve-like outer wall encircling and extending coaxially with said partition wall in substantially uniformly spaced relationship therewith and without any spacing elements between the partition wall and the outer wall, the axial ends of said cylindrical outer wall being sealingly connected to the outer surface of the partition wall and the outer wall being provided with an inlet and an outlet for a flow of said second medium intended to be passed through said second heat-exchange chamber defined by said partition wall and said outer wall, said cylindrical outer wall being formed of an elasticly flexible polymeric material so that said outer wall can move relative to the partition wall and the radial spacing between the outer wall and the partition wall can vary depending on the volumetric rate of said flow of said second medium and so that said outer wall can be brought into contact with said partition wall by the exertion of an external pressure on said outer wall, the outer surface of said partition wall being provided with axially extending, radially projecting fins integral with the partition wall and the inner surface of said outer wall being provided with axially extending radially inwardly directed fins integral with said outer wall and located between said fins of the partition wall, said inlet and said outlet for said flow of said second medium being located in the vicinity of a respective axial end of the outer wall.

6. A heat exchanger as claimed in claim 5, wherein said fins of said outer wall have a smaller radial dimension than said fins of said partition wall.

7. A heat exchanger as claimed in claim 5, wherein said fins of said partition wall as well as said fins of said outer wall have a trapezoidal cross-sectional shape.

* * * * *